US007423592B2

(12) United States Patent
Pros et al.

(10) Patent No.: US 7,423,592 B2
(45) Date of Patent: Sep. 9, 2008

(54) MULTI-BAND MONOPOLE ANTENNAS FOR MOBILE COMMUNICATIONS DEVICES

(75) Inventors: Jaume Anguera Pros, Castellon (ES); Carles Puente Baliarda, Barcelona (ES

(73) Assignee: Fractus, S.A., Barcelona (ES)

( * ) Notice: Subject to any disclaimer, the term of this patent is extended or adjusted under 35 U.S.C. 154(b) by 0 days.

(21) Appl. No.: 10/584,442

(22) PCT Filed: Jan. 28, 2005

(86) PCT No.: PCT/EP2005/000880

§ 371 (c)(1),
(2), (4) Date: Jul. 18, 2006

(87) PCT Pub. No.: WO2005/076407

PCT Pub. Date: Aug. 18, 2005

(65) Prior Publication Data

US 2007/0046548 A1 Mar. 1, 2007

Related U.S. Application Data

(63) Continuation-in-part of application No. PCT/EP02/14706, filed on Dec. 22, 2002.

(60) Provisional application No. 60/540,450, filed on Jan. 30, 2004.

(51) Int. Cl.
*H01Q 1/38* (2006.01)

(52) U.S. Cl. ..... 343/700 MS; 343/895; 343/702

(58) Field of Classification Search ..... 343/700 MS, 343/895, 702
See application file for complete search history.

(56) References Cited

U.S. PATENT DOCUMENTS 4,123,756 A 10/1978 Nagata (Continued)

FOREIGN PATENT DOCUMENTS

EP 0 884 796 12/1998

(Continued)

OTHER PUBLICATIONS

C. Puente et al., "Small But Long Koch Fractal Monopole", Electronics Letters, Jan. 8, 1998, vol. 34, No. 1, pp. 9-10.

(Continued)

*Primary Examiner*—Hoang V Nguyen
(74) *Attorney, Agent, or Firm*—Winstead PC

(57) ABSTRACT

Antennas for use in mobile communication devices are disclosed. The antennas disclosed can include a substrate with a base, a top, a front side and a back side; a first conductor can be located on the first side of the antenna substrate; and a second conductor can be located on the second side of the antenna substrate. The conductors can have single or multiple branches. If a conductor is a single branch it can, for example, be a spiral conductor or a conducting plate. If a conductor has multiple branches, each branch can be set up to receive a different frequency band. A conductor with multiple branches can have a linear branch and a space-filling or grid dimension branch. A conducting plate can act as a parasitic reflector plane to tune or partially tune the resonant frequency of another conductor. The first and second conductors can be electrically connected.

15 Claims, 17 Drawing Sheets

U.S. PATENT DOCUMENTS

| | | | | |
|---|---|---|---|---|
| 4,389,651 | A | | 6/1983 | Tomasky |
| 4,578,654 | A | * | 3/1986 | Tait ..... 333/175 |
| 5,248,988 | A | | 9/1993 | Makino |
| 5,337,065 | A | | 8/1994 | Bonnet et al. |
| 5,457,469 | A | | 10/1995 | Diamond |
| 5,572,223 | A | | 11/1996 | Phillips |
| 5,608,417 | A | * | 3/1997 | de Vall ..... 343/895 |
| 5,870,066 | A | | 2/1999 | Asakura et al. |
| 5,929,825 | A | | 7/1999 | Niu et al. |
| 5,943,020 | A | | 8/1999 | Liebendoerfer et al. |
| 5,963,871 | A | | 10/1999 | Zhinong et al. |
| 5,986,610 | A | | 11/1999 | Miron |
| 5,990,838 | A | | 11/1999 | Burns |
| 5,990,849 | A | * | 11/1999 | Salvail et al. ..... 343/895 |
| 6,104,349 | A | | 8/2000 | Cohen |
| 6,111,545 | A | | 8/2000 | Saari et al. |
| 6,112,102 | A | | 8/2000 | Zhinong et al. |
| 6,130,651 | A | | 10/2000 | Yanagisawa et al. |
| 6,140,975 | A | | 10/2000 | Cohen |
| 6,166,694 | A | | 12/2000 | Ying et al. |
| 6,266,023 | B1 | | 7/2001 | Nagy |
| 6,271,794 | B1 | | 8/2001 | Geeraert |
| 6,275,198 | B1 | | 8/2001 | Kenoun et al. |
| 6,281,846 | B1 | | 8/2001 | Puente |
| 6,307,511 | B1 | | 10/2001 | Ying et al. |
| 6,329,962 | B2 | | 12/2001 | Ying et al. |
| 6,337,663 | B1 | | 1/2002 | Chi-Ming et al. |
| 6,337,667 | B1 | | 1/2002 | Ayala et al. |
| 6,343,208 | B1 | | 1/2002 | Ying |
| 6,384,790 | B2 | | 5/2002 | Dishart |
| 6,445,352 | B1 | | 9/2002 | Cohen |
| 6,459,413 | B1 | | 10/2002 | Tseng et al. |
| 6,614,400 | B2 | | 9/2003 | Egorov |
| 6,664,930 | B2 | | 12/2003 | Wen et al. |
| 6,674,405 | B2 | | 1/2004 | Wang |
| 6,801,164 | B2 | | 10/2004 | Bit-Babik |
| 6,822,611 | B1 | | 11/2004 | Kontogeorgakis et al. |
| 6,839,040 | B2 | | 1/2005 | Huber |
| 6,864,854 | B2 | | 3/2005 | Dai et al. |
| 6,950,071 | B2 | | 9/2005 | Wen |
| 6,963,310 | B2 | | 11/2005 | Horita et al. |
| 7,057,560 | B2 | | 6/2006 | Erkocevic |
| 7,068,230 | B2 | | 6/2006 | Qi et al. |
| 7,069,043 | B2 | | 6/2006 | Sawamura |
| 7,081,857 | B2 | | 7/2006 | Kinnunen et al. |
| 7,126,537 | B2 | | 10/2006 | Cohen |
| 7,289,072 | B2 | | 10/2007 | Sakurai |
| 2001/0002823 | A1 | | 6/2001 | Ying |
| 2001/0050637 | A1 | | 12/2001 | Aoyama et al. |
| 2002/0000940 | A1 | | 1/2002 | Moren et al. |
| 2002/0044090 | A1 | | 4/2002 | Bahr et al. |
| 2002/0080088 | A1 | | 6/2002 | Boyle |
| 2002/0140615 | A1 | | 10/2002 | Carles et al. |
| 2002/0149527 | A1 | | 10/2002 | Wen |
| 2002/0175866 | A1 | | 11/2002 | Gram |
| 2002/0190904 | A1 | | 12/2002 | Cohen |
| 2003/0184482 | A1 | | 10/2003 | Bettin |
| 2003/0210187 | A1 | | 11/2003 | Wong et al. |
| 2004/0004574 | A1 | | 1/2004 | Wen |
| 2004/0027295 | A1 | | 2/2004 | Huber et al. |
| 2004/0095289 | A1 | | 5/2004 | Bae et al. |
| 2004/0140938 | A1 | | 7/2004 | Kadambi |
| 2004/0212545 | A1 | | 10/2004 | Li |
| 2005/0237244 | A1 | | 10/2005 | Annabi et al. |
| 2005/0259031 | A1 | | 11/2005 | Sanz et al. |
| 2006/0033668 | A1 | | 2/2006 | Ryu |
| 2006/0170610 | A1 | | 8/2006 | Rabinovich et al. |
| 2007/0046548 | A1 | | 3/2007 | Pros et al. |
| 2007/0152894 | A1 | | 7/2007 | Sanz et al. |
| 2007/0152984 | A1 | | 7/2007 | Sanz et al. |

FOREIGN PATENT DOCUMENTS

| | | | |
|---|---|---|---|
| EP | 0938158 | A2 | 2/1999 |
| EP | 0938158 | | 8/1999 |
| EP | 0 986 130 | | 3/2000 |
| EP | 1011167 | A1 | 6/2000 |
| EP | 1 091 445 | | 4/2001 |
| EP | 1 198 027 | | 4/2002 |
| EP | 0 777 293 | | 7/2002 |
| EP | 1 237 224 | | 9/2002 |
| EP | 1367671 | | 12/2003 |
| EP | 1367671 | A2 | 12/2003 |
| GB | 2 361 584 | | 10/2001 |
| JP | 10247808 | | 9/1998 |
| JP | 2001-217632 | | 8/2001 |
| JP | 2001332924 | | 11/2001 |
| JP | 2002050919 | | 2/2002 |
| WO | WO-96/38881 | | 12/1996 |
| WO | WO-99/56345 | | 11/1999 |
| WO | 99/67851 | A1 | 12/1999 |
| WO | 00/03451 | A1 | 1/2000 |
| WO | WO-00/77884 | | 12/2000 |
| WO | WO-01/11721 | | 2/2001 |
| WO | WO-01/26182 | | 4/2001 |
| WO | WO-01/48861 | | 7/2001 |
| WO | WO-01/54225 | | 7/2001 |
| WO | 0003451 | A1 | 1/2002 |
| WO | 0235652 | A1 | 5/2002 |
| WO | WO-02/35646 | | 5/2002 |
| WO | 02078123 | A1 | 10/2002 |
| WO | 03034538 | A1 | 4/2003 |
| WO | 03034544 | A1 | 4/2003 |
| WO | 2004001894 | A1 | 12/2003 |
| WO | WO-2004/025778 | | 3/2004 |
| WO | 2004042868 | A1 | 5/2004 |
| WO | 2004/057701 | A1 | 7/2004 |
| WO | 2005076409 | A1 | 8/2005 |

OTHER PUBLICATIONS

Carles Puente Baliarda et al., "The Koch Monopole: A Small Fractal Antenna", IEEE Transactions on Antennas and Propagation, vol. 48, No. 11, Nov. 2000, pp. 1773-1781.

Nathan Cohen, "Fractal Antenna Applications in Wireless Telecommunications", IEEE, 1997, pp. 43-49.

C. Puente et al., "Multiband Properties of a Fractal Tree Antenna Generated by Electrochemical Deposition", Electronics Letters, Dec. 5, 1996, vol. 32, No. 25, pp. 2298-2299.

Puente, Fractal antennas, Universitat Politécnica de Catalunya, 1997.

Puente, Multiband fractal antennas and arrays, Fractals engineering—from theory to industrial applications, 1994.

Nakano et al. Realization of dual-frequency and wide-band VSWR performances using normal-mode helical and inverted-F antennas, IEEE Transactions on Antennas and Propagation, 1998, vol. 46, No. 6, no date avail.

Morishita et al., Design concept of antennas for small mobile terminals and the future perspective, IEEE Antennas and Propagation Magazine, 2002.

Dou et al, Small broadband stacked planar monopole, Willey Interscience, 2000.

Strugatsky, Multimode multiband antenna. Tactical communications: Technology in transition. Proceedings of the tactical communications conference, 1992.

Szkipala, Fractal antennas, TEAT, 2001.

Wong, Planar antennas for wireless communications, John Wiley & Sons, 2003.

Sim, An internal triple-band antenna for PCS/IMT-2000/Bluetooth applications, IEEE Antennas and Wireless Propagation Letters, 2004, vol. 3.
Wong, Planar antennas for wireless communications, Wiley Interscience, 2003.
Handbook of antennas in wireless communications, CRC Press, 2002.
Cohen, N. Fractal antenna applications in wireless telecommunications, Professional Program Proceedings, Electronics Industries Forum of New England, May 1997.

* cited by examiner

MULTI-BAND MONOPOLE ANTENNAS FOR MOBILE COMMUNICATIONS DEVICES

This patent application is a national stage entry of PCT/EP05/00880 filed on Jan. 28, 2005,which is a continuation-in-part of PCT/EP02/14706 filed Dec. 22, 2002. PCT/EP05/00880 claims priority from provisional application 60/540,450 filed on Jan. 30,2004.

INTRODUCTION

This invention relates generally to the field of multi-band monopole internal and external antennas. More specifically, multi-band monopole antennas are provided that are particularly well-suited for use in mobile communications devices, such as Personal Digital Assistants, cellular telephones, and pagers.

BACKGROUND

Multi-band antenna structures for use in a mobile communications device are known in this art. For example, one type of antenna structure that is commonly utilized as an internally-mounted antenna for a mobile communication device is known as an "inverted-F" antenna. When mounted inside a mobile communications device, an antenna is often subject to problematic amounts of electromagnetic interference from other metallic objects within the mobile communications device, particularly from the ground plane. An inverted-F antenna has been shown to perform adequately as an internally mounted antenna, compared to other known antenna structures. Inverted-F antennas, however, are typically bandwidth-limited, and thus may not be well suited for bandwidth intensive applications. An example of an antenna structure that is used as an externally mounted antenna for a mobile communication device is known as a space-filling or grid dimension antenna. External mounting reduces the amount of electromagnetic interference from other metal objects within the mobile communication device.

SUMMARY

Antennas for use in mobile communication devices are disclosed. The antennas disclosed can include a substrate with a base, a top, a front side and a back side; a first conductor can be located on the first side of the antenna substrate; and a second conductor can be located on the second side of the antenna substrate. The conductors can have single or multiple branches. If a conductor is a single branch it can, for example, be a spiral conductor or a conducting plate. If a conductor has multiple branches, each branch can be set up to receive a different frequency band. A conductor with multiple branches can have a linear branch and a space-filling or grid dimension branch. A conducting plate can act as a parasitic reflector plane to tune or partially tune the resonant frequency of another conductor. The first and second conductors can be electrically connected.

DETAILED DESCRIPTION

Figure 1:
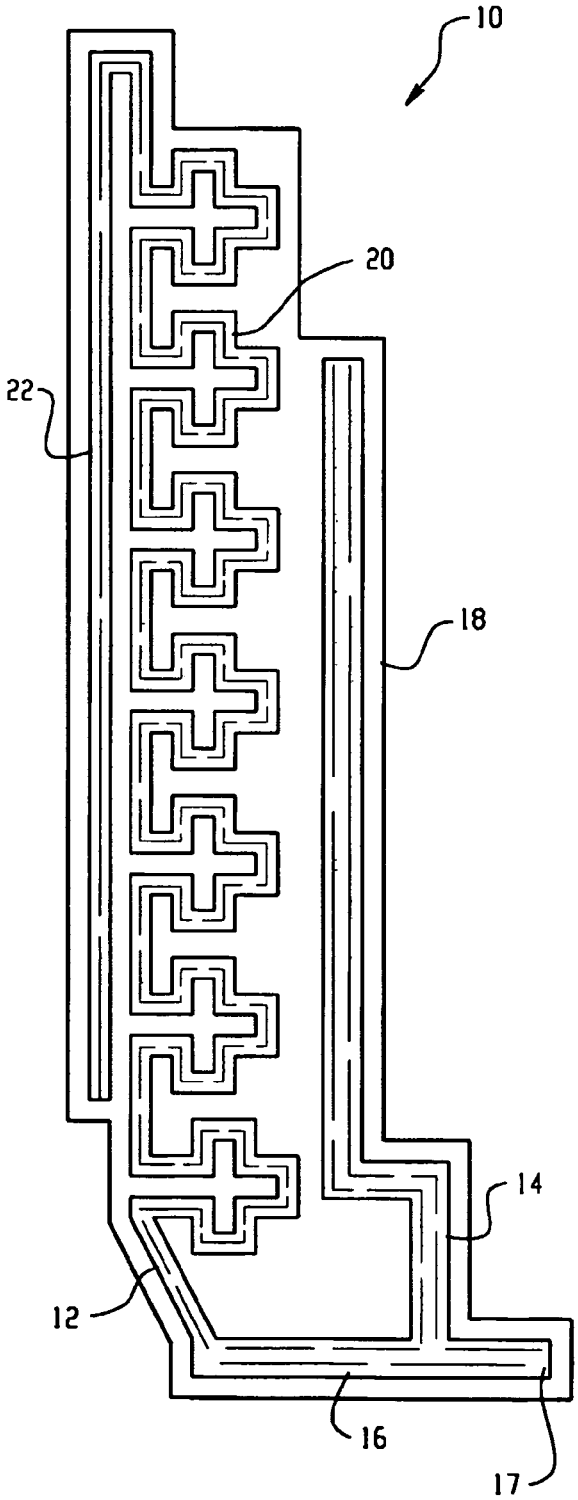
FIG. 1 is a top view of an exemplary multi-band monopole antenna for a mobile communications device.

Referring now to the drawing figures, FIG. 1 is a top view of an exemplary multi-band monopole antenna 10 for a mobile communications device. The multi-band monopole antenna 10 includes a first radiating arm 12 and a second radiating arm 14 that are both coupled to a feeding port 17 through a common conductor 16. The antenna 10 also includes a substrate material 18 on which the antenna structure 12, 14, 16 is fabricated, such as a dielectric substrate, a flex-film substrate, or some other type of suitable substrate material. The antenna structure 12, 14, 16 is preferably patterned from a conductive material, such as a metallic thick-film paste that is printed and cured on the substrate material 18, but may alternatively be fabricated using other known fabrication techniques.

The first radiating arm 12 includes a meandering section 20 and an extended section 22. The meandering section 20 is coupled to and extends away from the common conductor 16. The extended section 22 is contiguous with the meandering section 20 and extends from the end of the meandering section 20 back towards the common conductor 16. In the illustrated embodiment, the meandering section 20 of the first radiating arm 12 is formed into a geometric shape known as a space-filling curve, in order to reduce the overall size of the antenna 10. A space-filling curve is characterized by at least ten segments which are connected in such a way that each segment forms an angle with its adjacent segments, that is, no pair of adjacent segments define a larger straight segment. It should be understood, however, that the meandering section 20 may include other space-filling curves than that shown in FIG. 1, or may optionally be arranged in an alternative meandering geometry. FIGS. 2-6, for example, illustrate antenna structures having meandering sections formed from several alternative geometries. The use of shape-filling curves to form antenna structures is described in greater detail in the co-owned PCT Application WO 01/54225, entitled Space-Filling Miniature Antennas, which is hereby incorporated into the present application by reference.

The second radiating arm 14 includes three linear portions. As viewed in FIG. 1, the first linear portion extends in a vertical direction away from the common conductor 16. The second linear portion extends horizontally from the end of the first linear portion towards the first radiating arm. The third linear portion extends vertically from the end of the second linear portion in the same direction as the first linear portion and adjacent to the meandering section 20 of the first radiating arm 14.

Figure 10:
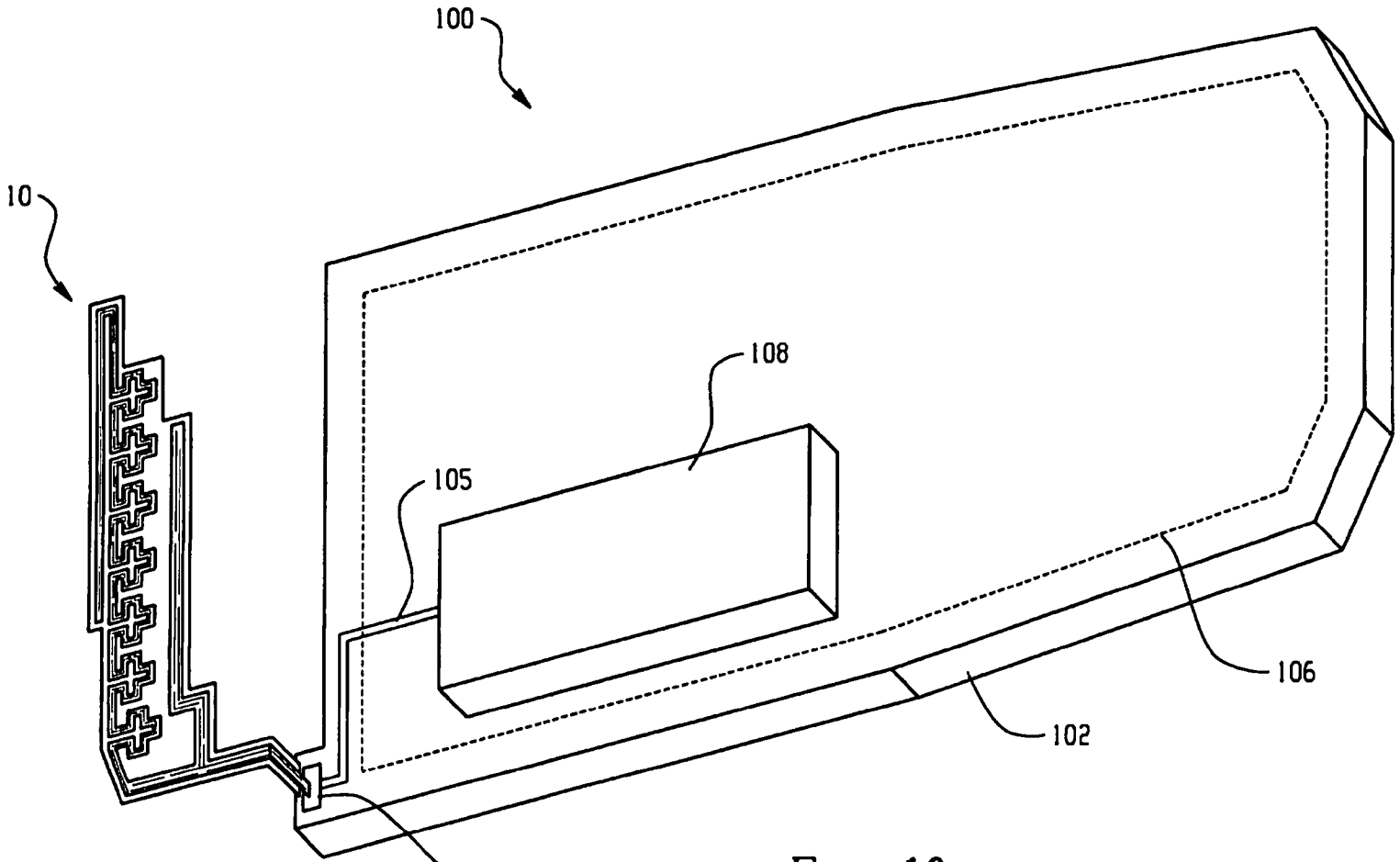
FIG. 10 is a top view of the exemplary multi-band monopole antenna of FIG. 1 coupled to a circuit board for a mobile communications device.

As noted above, the common conductor 16 of the antenna 10 couples the feeding port 17 to the first and second radiating arms 12, 14. The common conductor 16 extends horizontally (as viewed in FIG. 1) beyond the second radiating arm 14, and may be folded in a perpendicular direction (perpendicularly into the page), as shown in FIG. 10, in order to couple the feeding port 17 to communications circuitry in a mobile communications device.

Operationally, the first and second radiating arms 12, 14 are each tuned to a different frequency band or bands, resulting in a dual-band or multi-band antenna.

The antenna 10 may be tuned to the desired dual-band operating frequencies of a mobile communications device by pre-selecting the total conductor length of each of the radiating arms 12, 14. For example, in the illustrated embodiment, the first radiating arm 12 may be tuned to operate in a lower frequency band or groups of bands, such as PDC (800 MHz), CDMA (800 MHz), GSM (850 MHz), GSM (900 MHz), GPS, or some other desired frequency band. Similarly, the second radiating arm 14 may be tuned to operate in a higher frequency band or group of bands, such as GPS, PDC (1500 MHz), GSM (1800 MHz), Korean PCS, CDMA/PCS (1900 MHz), CDMA2000/UMTS, IEEE 802.11 (2.4 GHz), IEEE 802.16 (Wi-MAX), or some other desired frequency band. It should be understood that, in some embodiments, the lower frequency band of the first radiating arm 12 may overlap the higher frequency band of the second radiating arm 14, resulting in a single broader band. It should also be understood that the multi-band antenna 10 may be expanded to include further frequency bands by adding additional radiating arms. For example, a third radiating arm could be added to the antenna 10 to form a tri-band antenna.

Figure 2:
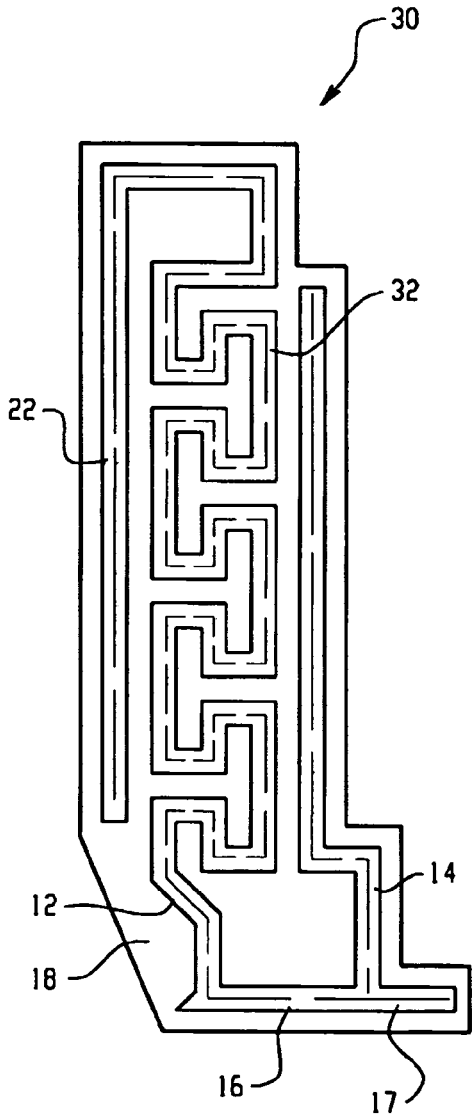
FIG. 2 is a top view of an exemplary multi-band monopole antenna including one alternative space-filling geometry.

FIG. 2 is a top view of an exemplary multi-band monopole antenna 30 including one alternative meandering geometry. The antenna 30 shown in FIG. 2 is similar to the multi-band antenna 10 shown in FIG. 1, except the meandering section 32 in the first radiating arm 12 includes a different curve than that shown in FIG. 1.

FIGS. 3-9 illustrate several alternative multi-band monopole antenna configurations 50, 70, 80, 90, 93, 95, 97. Similar to the antennas 10, 30 shown in FIGS. 1 and 2, the multi-band monopole antenna 50 illustrated in FIG. 3 includes a common conductor 52 coupled to a first radiating arm 54 and a second radiating arm 56. The common conductor 52 includes a feeding port 62 on a linear portion of the common conductor 52 that extends horizontally (as viewed in FIG. 3) away from the radiating arms 54, 56, and that may be folded in a perpendicular direction (perpendicularly into the page) in order to couple the feeding port 62 to communications circuitry in a mobile communications device.

The first radiating arm 54 includes a meandering section 58 and an extended section 60. The meandering section 58 is coupled to and extends away from the common conductor 52. The extended section 60 is contiguous with the meandering section 58 and extends from the end of the meandering section 58 in an arcing path back towards the common conductor 52.

The second radiating arm 56 includes three linear portions. As viewed in FIG. 3, the first linear portion extends diagonally away from the common conductor 52. The second linear portion extends horizontally from the end of the first linear portion towards the first radiating arm. The third linear portion extends vertically from the end of the second linear portion away from the common conductor 52 and adjacent to the meandering section 58 of the first radiating arm 54.

Figure 3:
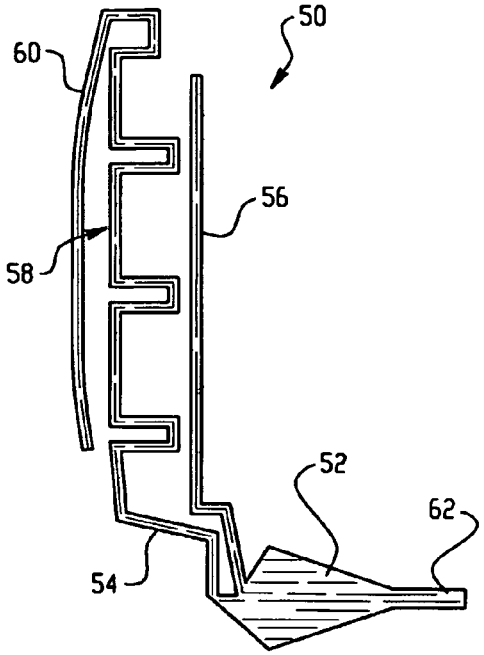
FIGS. 3-9 illustrate several alternative multi-band monopole antenna configurations.
Figure 4:
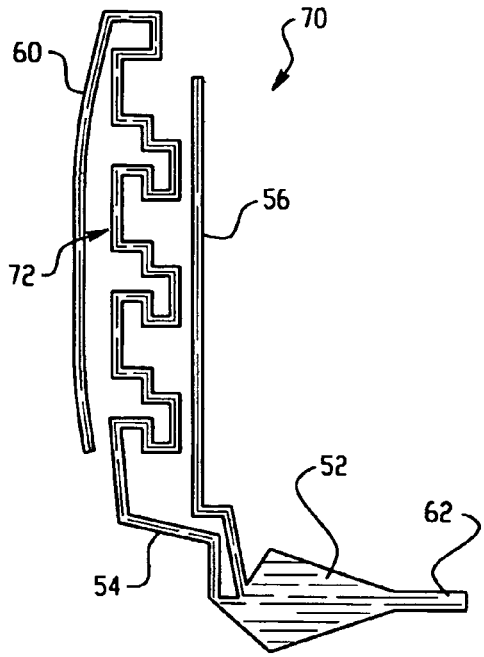
Figure 5:
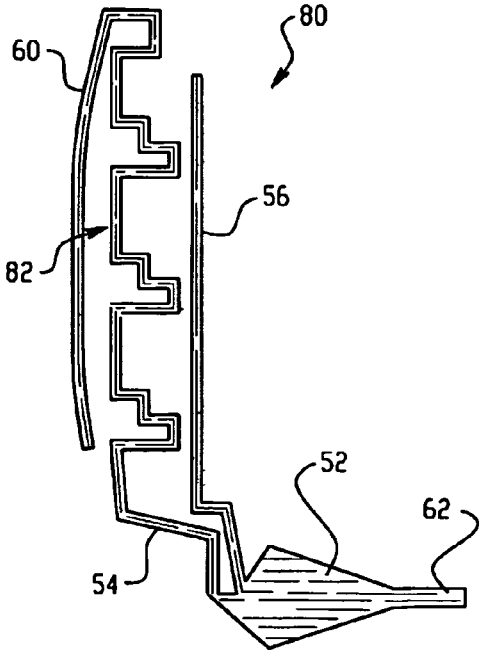
Figure 6:
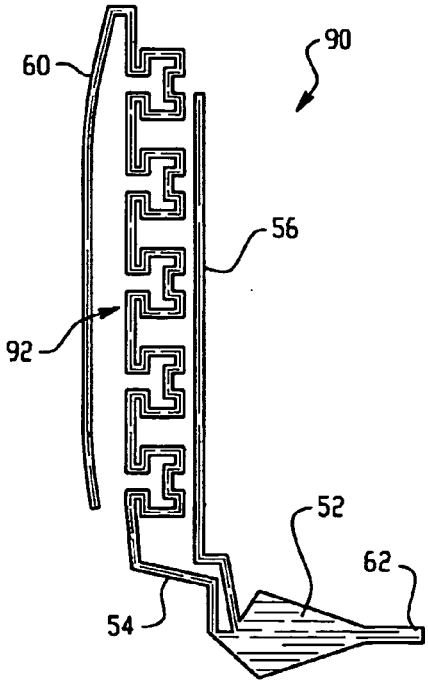

The multi-band monopole antennas 70, 80, 90 illustrated in FIGS. 4-6 are similar to the antenna 50 shown in FIG. 3, except each includes a differently-patterned meandering portion 72, 82, 92 in the first radiating arm 54. For example, the meandering portion 92 of the multi-band antenna 90 shown in FIG. 6 meets the definition of a space-filling curve, as described above. The meandering portions 58, 72, 82 illustrated in FIGS. 3-5, however, each include differently-shaped periodic curves that do not meet the requirements of a space-filling curve.

Figure 9:
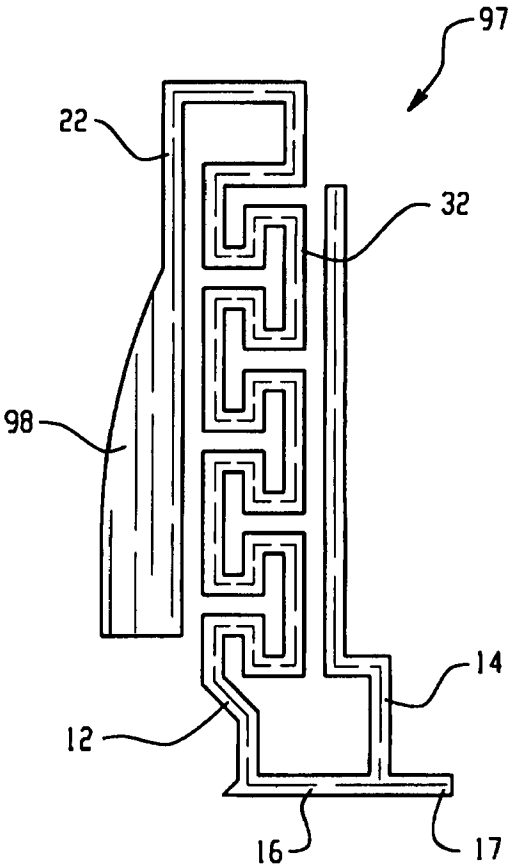
Figure 8:
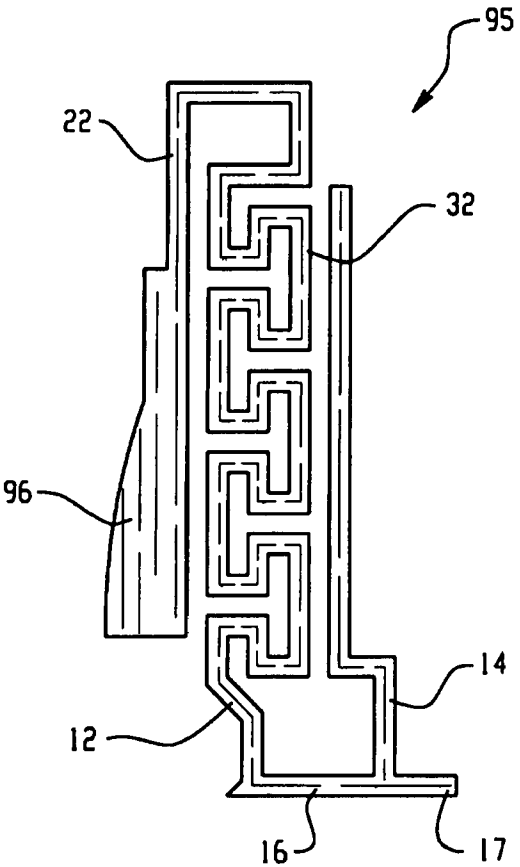
Figure 7:
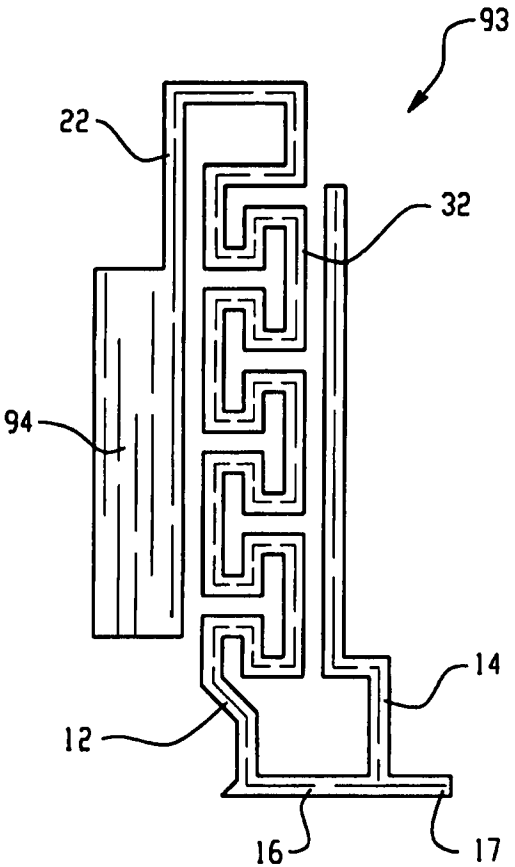

The multi-band monopole antennas 93, 95, 97 illustrated in FIGS. 7-9 are similar to the antenna 30 shown in FIG. 2, except in each of FIGS. 7-9 the expanded portion 22 of the first radiating arm 12 includes an additional area 94, 96, 98. In FIG. 7, the expanded portion 22 of the first radiating arm 12 includes a polygonal portion 94. In FIGS. 8 and 9, the expanded portion 22 of the first radiating arm 12 includes a portion 96, 98 with an arcuate longitudinal edge.

FIG. 10 is a top view 100 of the exemplary multi-band monopole antenna 10 of FIG. 1 coupled to the circuit board 102 of a mobile communications device. The circuit board 102 includes a feeding point 104 and a ground plane 106. The ground plane 106 may, for example, be located on one of the surfaces of the circuit board 102, or may be one layer of a multi-layer printed circuit board. The feeding point 104 may, for example, be a metallic bonding pad that is coupled to circuit traces 105 on one or more layers of the circuit board 102. Also illustrated, is communication circuitry 108 that is coupled to the feeding point 104. The communication circuitry 108 may, for example, be a multi-band transceiver circuit that is coupled to the feeding point 104 through circuit traces 105 on the circuit board.

In order to reduce electromagnetic interference or electromagnetic coupling from the ground plane 106, the antenna 10 is mounted within the mobile communications device such that 50% or less of the projection of the antenna footprint on the plane of the circuit board 102 intersects the metalization of the ground plane 106. In the illustrated embodiment 100, the antenna 10 is mounted above the circuit board 102. That is, the circuit board 102 is mounted in a first plane and the antenna 10 is mounted in a second plane within the mobile communications device. In addition, the antenna 10 is laterally offset from an edge of the circuit board 102, such that, in this embodiment 100, the projection of the antenna footprint on the plane of the circuit board 102 does not intersect any of the metalization of the ground plane 106.

In order to further reduce electromagnetic interference or electromagnetic coupling from the ground plane 106, the feeding point 104 is located at a position on the circuit board 102 adjacent to a corner of the ground plane 106. The antenna 10 is preferably coupled to the feeding point 104 by folding a portion of the common conductor 16 perpendicularly towards the plane of the circuit board 102 and coupling the feeding port 17 of the antenna 10 to the feeding point 104 of the circuit board 102. The feeding port 17 of the antenna 10 may, for example, be coupled to the feeding point 104 using a commercially available connector, by bonding the feeding port 17 directly to the feeding point 104, or by some other suitable coupling means, such as for example a built-in or surface-mounted spring contact. In other embodiments, however, the feeding port 17 of the antenna 10 may be coupled to the feeding point 104 by some means other than folding the common conductor 16.

Figure 11:
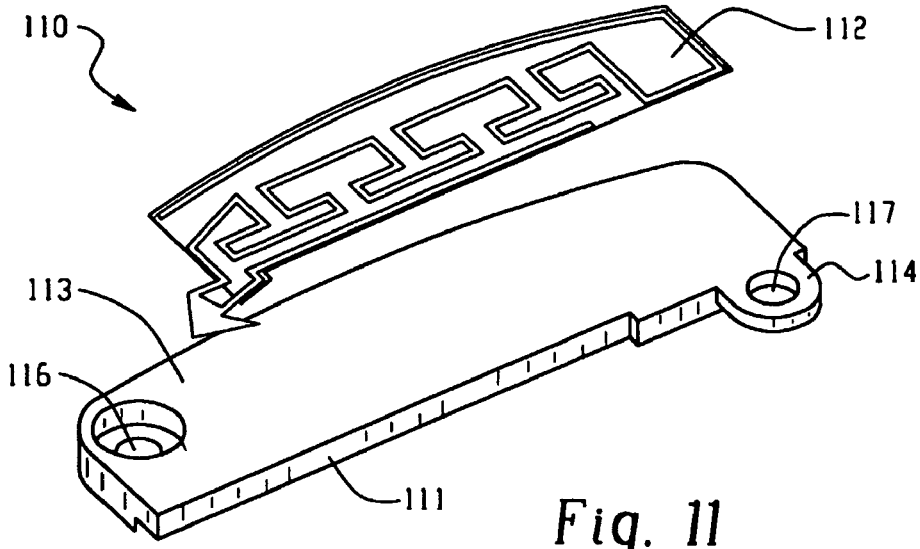
FIG. 11 shows an exemplary mounting structure for securing a multi-band monopole antenna within a mobile communications device.

FIG. 11 shows an exemplary mounting structure 111 for securing a multi-band monopole antenna 112 within a mobile communications device. The illustrated embodiment 110 employs a multi-band monopole antenna 112 having a meandering section similar to that shown in FIG. 2. It should be understood, however, that alternative multi-band monopole antenna configurations, as described in FIGS. 1-9, could also be used.

The mounting structure 111 includes a flat surface 113 and at least one protruding section 114. The antenna 112 is secured to the flat surface 113 of the mounting structure 111, preferably using an adhesive material. For example, the antenna 112 may be fabricated on a flex-film substrate having a peel-type adhesive on the surface opposite the antenna structure. Once the antenna 112 is secured to the mounting structure 111, the mounting structure 111 is positioned in a mobile communications device with the protruding section 114 extending over the circuit board. The mounting structure 111 and antenna 112 may then be secured to the circuit board and to the housing of the mobile communications device using one or more apertures 116, 117 within the mounting structure 111.

Figure 12:
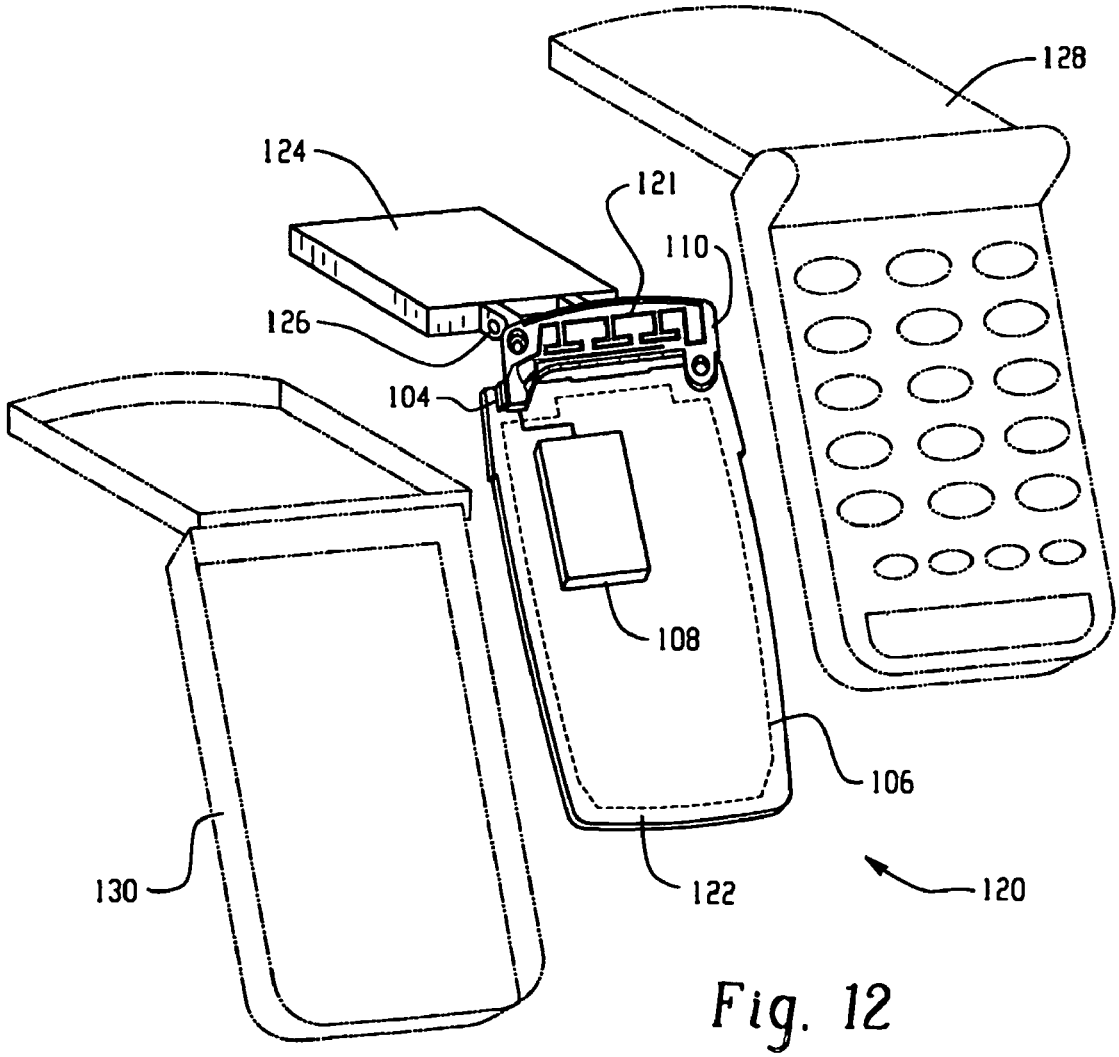
FIG. 12 is an exploded view of an exemplary clamshell-type cellular telephone having a multi-band monopole antenna.

FIG. 12 is an exploded view of an exemplary clamshell-type cellular telephone 120 having a multi-band monopole antenna 121. The cellular telephone 120 includes a lower circuit board 122, an upper circuit board 124, and the multi-band antenna 121 secured to a mounting structure 110. Also illustrated are an upper and a lower housing 128, 130 that join to enclose the circuit boards 122, 124 and antenna 121. The illustrated multi-band monopole antenna 121 is similar to the multi-band antenna 30 shown in FIG. 2. It should be understood, however, that alternative antenna configurations, as describe above with reference to FIGS. 1-9, could also be used.

The lower circuit board 122 is similar to the circuit board 102 described above with reference to FIG. 10, and includes a ground plane 106, a feeding point 104, and communications circuitry 108. The multi-band antenna 121 is secured to a mounting structure 110 and coupled to the lower circuit board 122, as described above with reference to FIGS. 10 and 11. The lower circuit board 122 is then connected to the upper circuit board 124 with a hinge 126, enabling the upper and lower circuit boards 122, 124 to be folded together in a manner typical for clamshell-type cellular phones. In order to further reduce electromagnetic interference from the upper and lower circuit boards 122, 124, the multi-band antenna 121 is preferably mounted on the lower circuit board 122 adjacent to the hinge 126.

Figure 13:
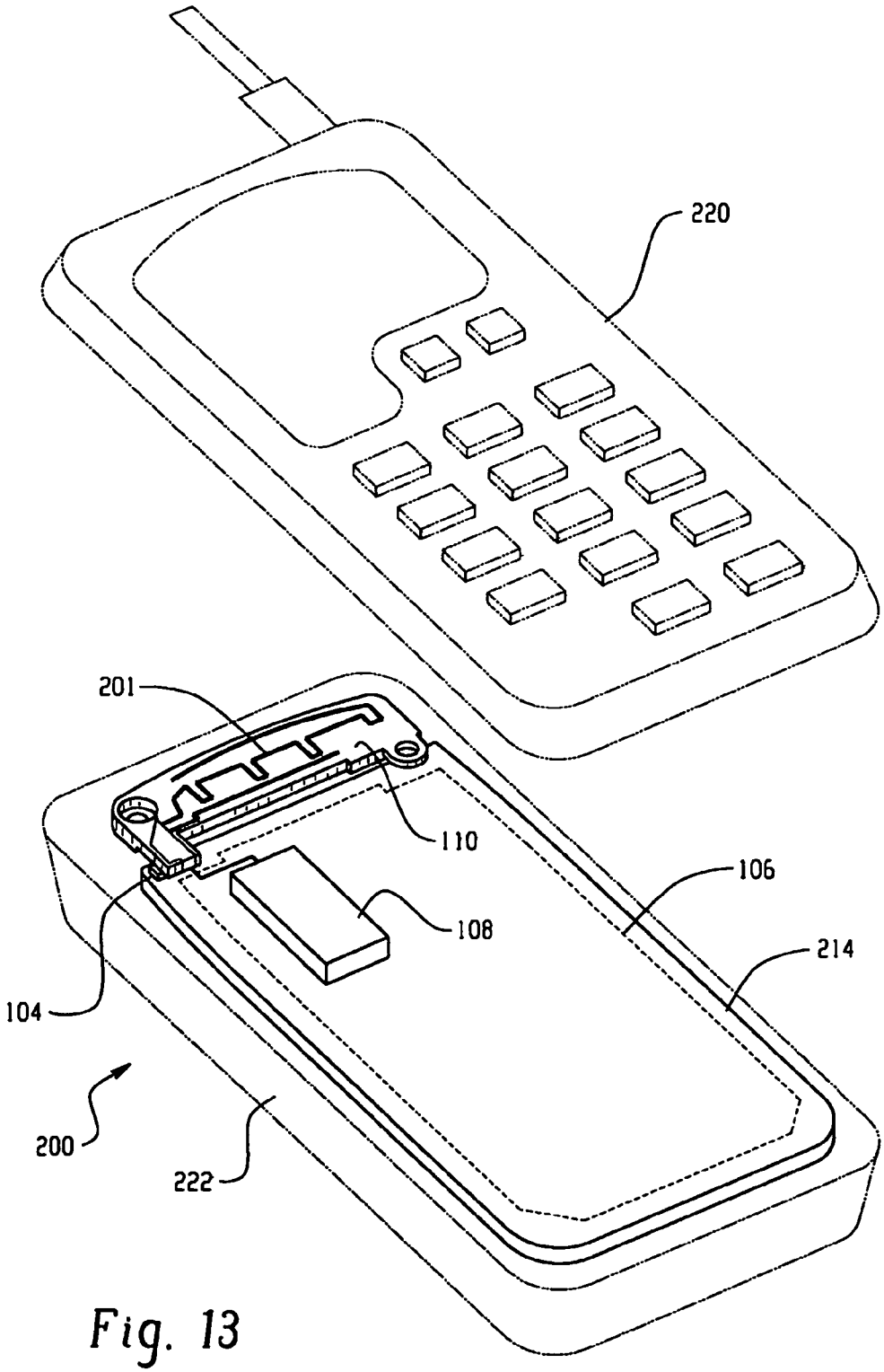
FIG. 13 is an exploded view of an exemplary candy-bar-style cellular telephone having a multi-band monopole antenna.

FIG. 13 is an exploded view of an exemplary candy-bar-type cellular telephone 200 having a multi-band monopole antenna 201. The cellular telephone 200 includes the multi-band monopole antenna 201 secured to a mounting structure 110, a circuit board 214, and an upper and lower housing 220, 222. The circuit board 214 is similar to the circuit board 102 described above with reference to FIG. 10, and includes a ground plane 106, a feeding point 104, and communications circuitry 108. The illustrated antenna 201 is similar to the multi-band monopole antenna shown in FIG. 3, however alternative antenna configurations, as described above with reference to FIGS. 1-9, could also be used.

The multi-band antenna 201 is secured to the mounting structure 110 and coupled to the circuit board 214 as described above with reference to FIGS. 10 and 11. The upper and lower housings 220, 222 are then joined to enclose the antenna 212 and circuit board 214.

Figure 14:
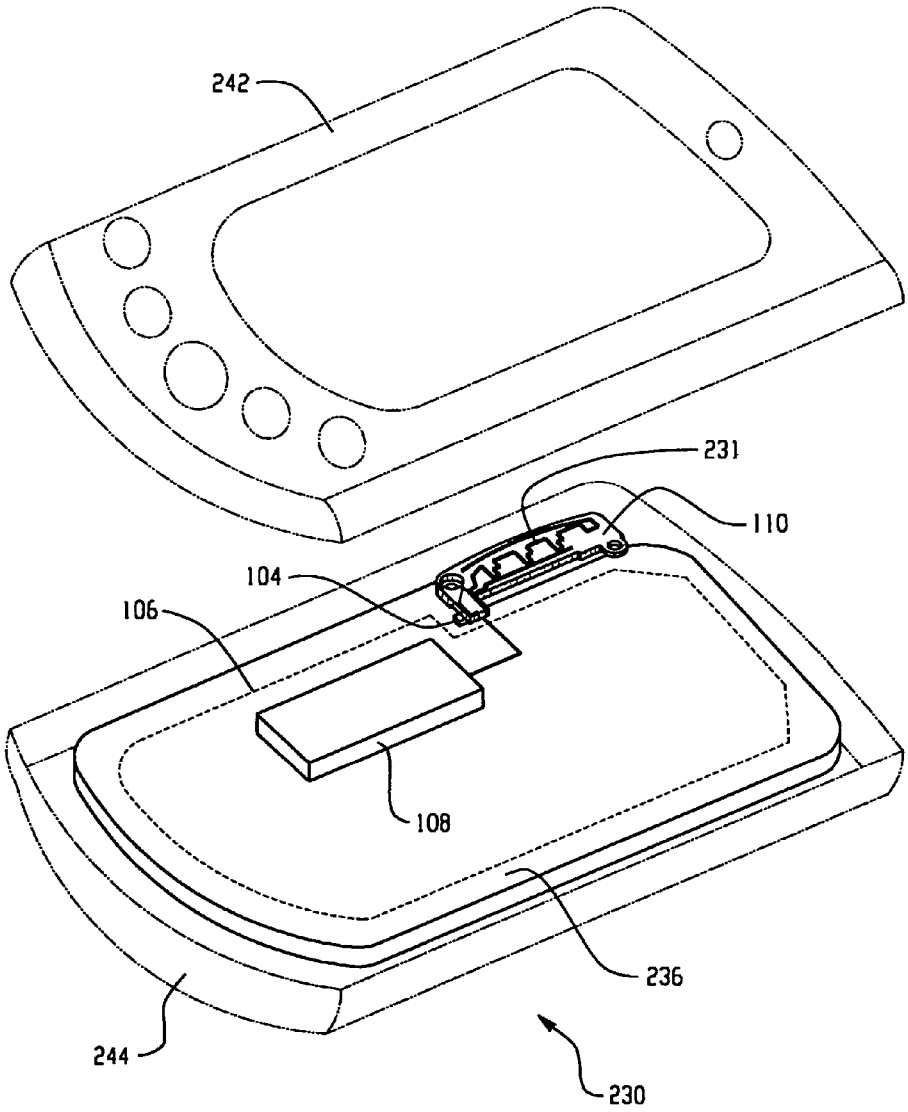
FIG. 14 is an exploded view of an exemplary personal digital assistant (PDA) having a multi-band monopole antenna.

FIG. 14 is an exploded view of an exemplary personal digital assistant (PDA) or gaming device 230 having a multi-band monopole antenna 231. The PDA 230 includes the multi-band monopole antenna 231 secured to a mounting structure 110, a circuit board 236, and an upper and lower housing 242, 244. Although shaped differently, the PDA circuit board 236 is similar to the circuit board 102 described above with reference to FIG. 10, and includes a ground plane 106, a feeding point 104, and communications circuitry 108. The illustrated antenna 231 is similar to the multi-band monopole antenna shown in FIG. 5, however alternative antenna configurations, as described above with reference to FIGS. 1-9, could also be used. As discussed above with respect to FIG. 10, preferably 50% or less of the antenna footprint on the plane of the circuit board 236 intersects the metalization of the ground plane.

The multi-band antenna 231 is secured to the mounting structure 110 and coupled to the circuit board 214 as described above with reference to FIGS. 10 and 11. In slight contrast to FIG. 10, however, the PDA circuit board 236 defines an L-shaped slot along an edge of the circuit board 236 into which the antenna 231 and mounting structure 110 are secured in order to conserve space within the PDA 230. The upper and lower housings 242, 244 are then joined together to enclose the antenna 231 and circuit board 236.

Figure 15:
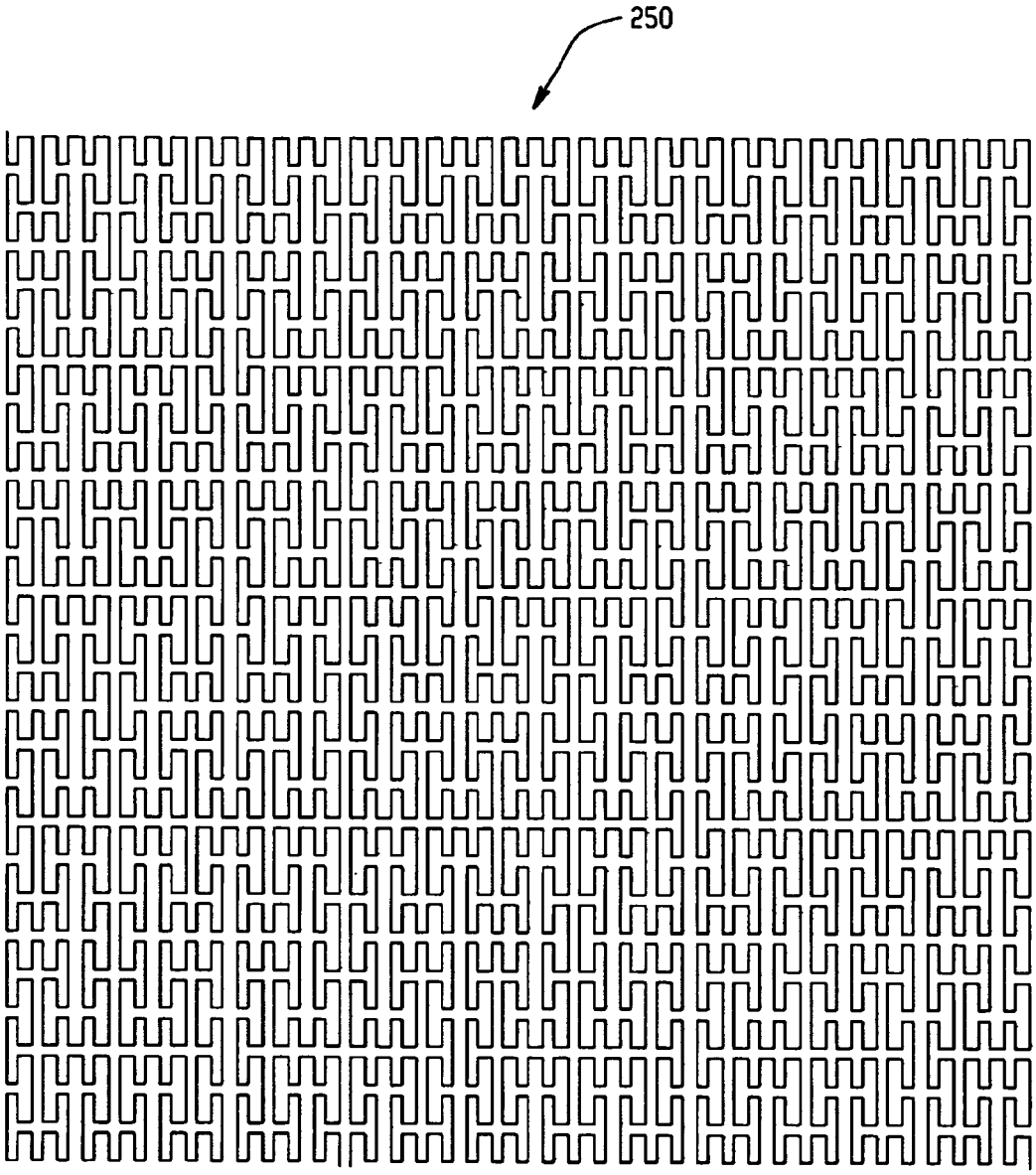
FIG. 15 shows one example of a space-filling curve.

An example of a space-filling curve 250 is shown in FIG. 15. As mentioned above, space-filling means a curve formed from a line that includes at least ten segments, with each segment forming an angle with an adjacent segment. When used in an antenna, each segment in a space-filling curve 250 should be shorter than one-tenth of the free-space operating wavelength of the antenna.

In addition to space-filling curves, the curves described herein can also be grid dimension curves. Examples of grid dimension curves are shown in FIGS. 16 to 19. The grid dimension of a curve may be calculated as follows. A first grid having square cells of length L1 is positioned over the geometry of the curve, such that the grid completely covers the curve. The number of cells (N1) in the first grid that enclose at least a portion of the curve are counted. Next, a second grid having square cells of length L2 is similarly positioned to completely cover the geometry of the curve, and the number of cells (N2) in the second grid that enclose at least a portion of the curve are counted. In addition, the first and second grids should be positioned within a minimum rectangular area enclosing the curve, such that no entire row or column on the perimeter of one of the grids fails to enclose at least a portion of the curve. The first grid should include at least twenty-five cells, and the second grid should include four times the number of cells as the first grid. Thus, the length (L2) of each square cell in the second grid should be one-half the length (L1) of each square cell in the first grid. The grid dimension ($D_g$) may then be calculated with the following equation:

$$D_g = -\frac{\log(N2) - \log(N1)}{\log(L2) - \log(L1)}$$

For the purposes of this application, the term grid dimension curve is used to describe a curve geometry having a grid dimension that is greater than one (1). The larger the grid dimension, the higher the degree of miniaturization that may be achieved by the grid dimension curve in terms of an antenna operating at a specific frequency or wavelength. In addition, a grid dimension curve may, in some cases, also meet the requirements of a space-filling curve, as defined above. Therefore, for the purposes of this application a space-filling curve is one type of grid dimension curve.

Figure 16:
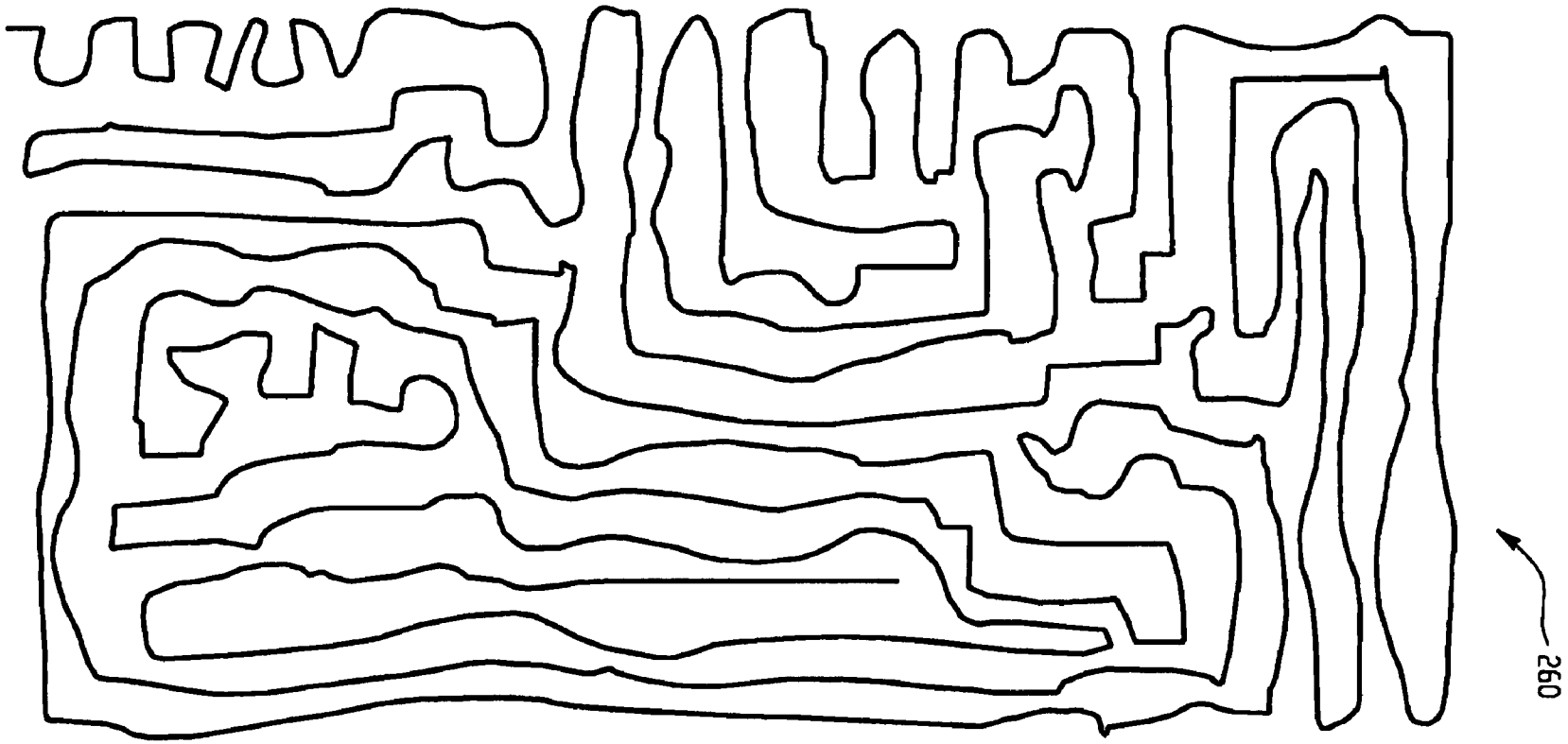
FIGS. 16-19 illustrate an exemplary two-dimensional antenna geometry forming a grid dimension curve.
Figure 17:
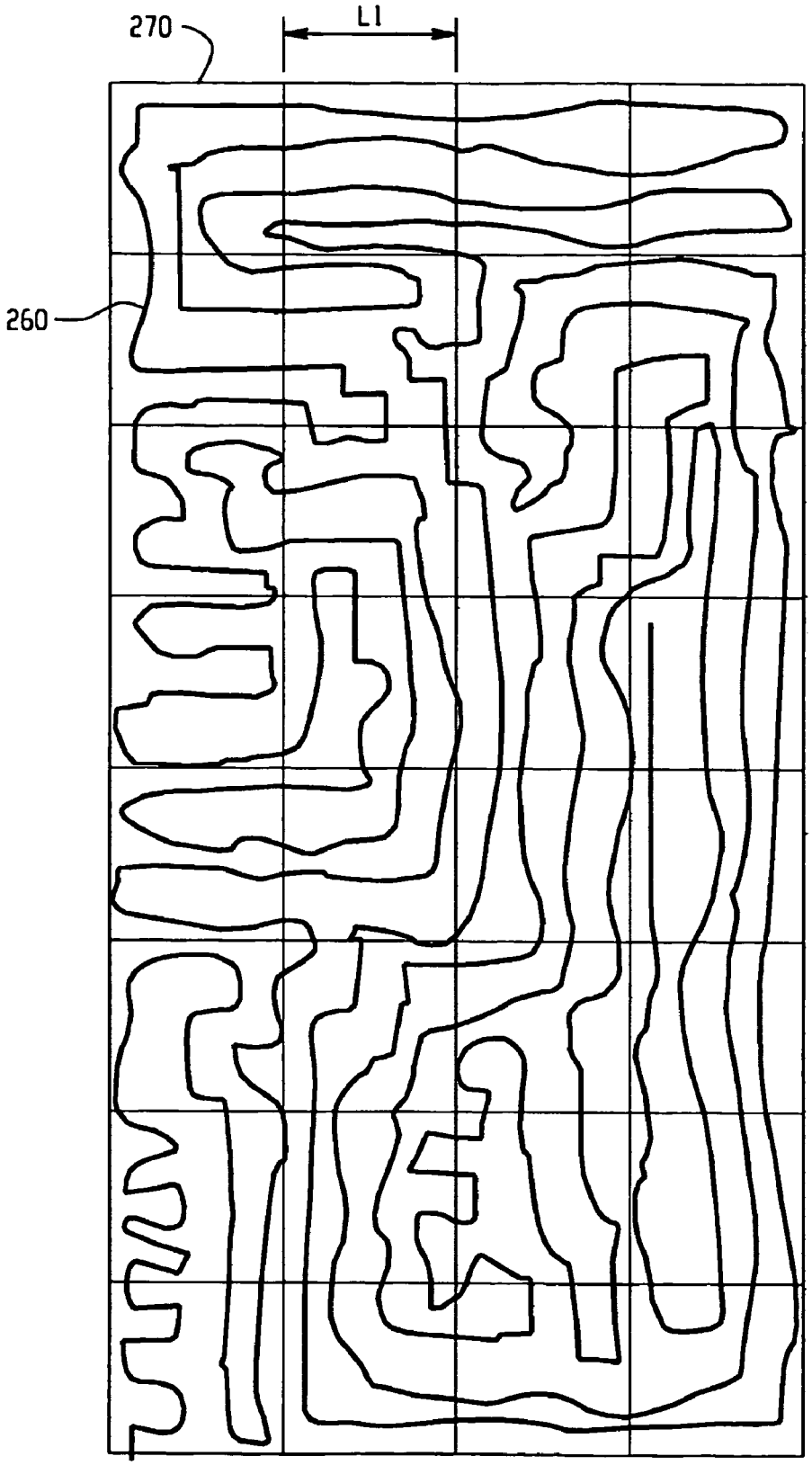
Figure 18:
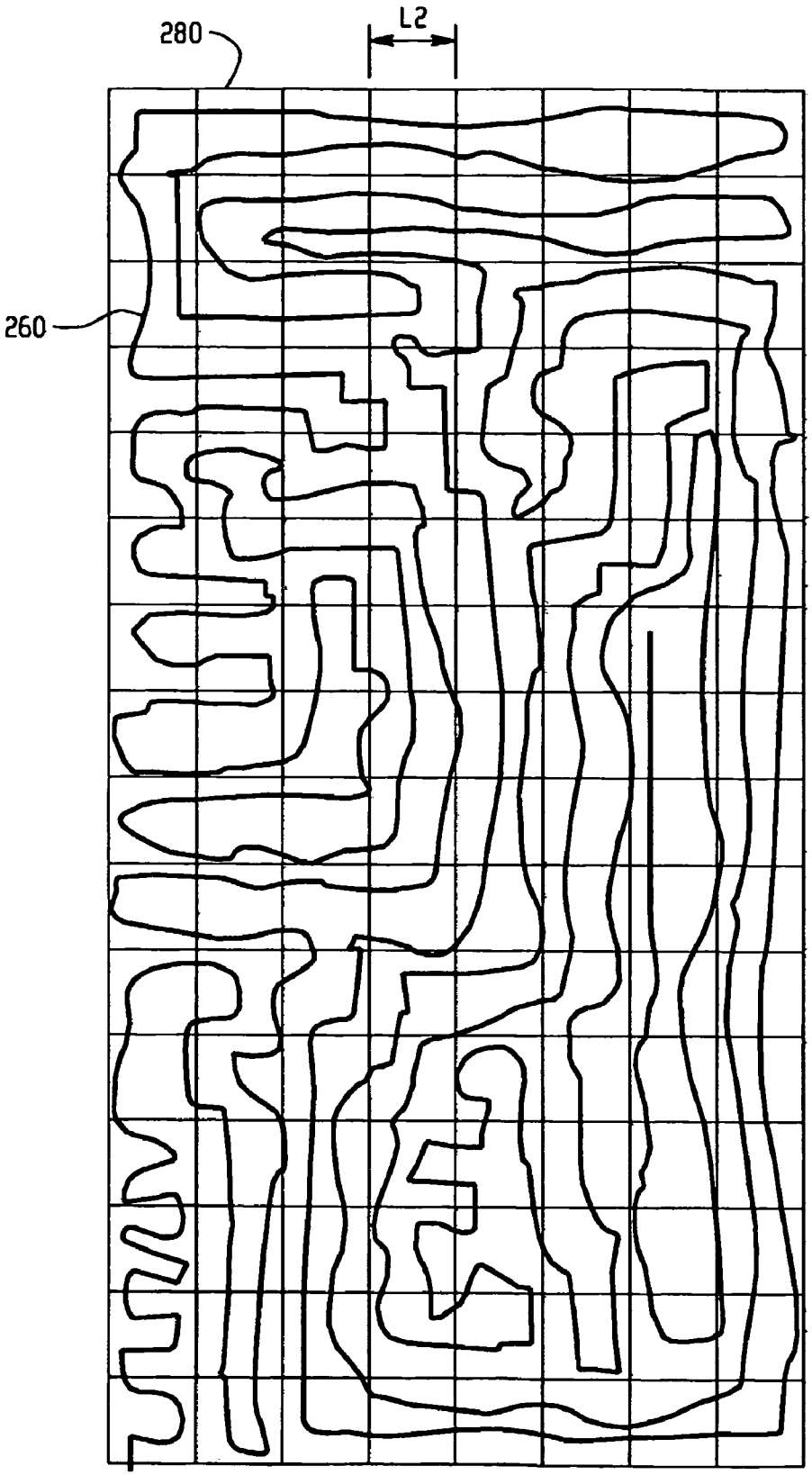

FIG. 16 shows an exemplary two-dimensional antenna 260 forming a grid dimension curve with a grid dimension of approximately two (2). FIG. 17 shows the antenna 260 of FIG. 16 enclosed in a first grid 270 having thirty-two (32) square cells, each with length L1. FIG. 18 shows the same antenna 260 enclosed in a second grid 280 having one hundred twenty-eight (128) square cells, each with a length L2. The length (L1) of each square cell in the first grid 270 is twice the length (L2) of each square cell in the second grid 280 (L2=2×L1). An examination of FIGS. 17 and 18 reveals that at least a portion of the antenna 260 is enclosed within every square cell in both the first and second grids 270, 280. Therefore, the value of N1 in the above grid dimension ($D_g$) equation is thirty-two (32) (i.e., the total number of cells in the first grid 270), and the value of N2 is one hundred twenty-eight (128) (i.e., the total number of cells in the second grid 280). Using the above equation, the grid dimension of the antenna 260 may be calculated as follows:

$$D_g = -\frac{\log(128) - \log(32)}{\log(2 \times L1) - \log(L1)} = 2$$

For a more accurate calculation of the grid dimension, the number of square cells may be increased up to a maximum amount. The maximum number of cells in a grid is dependent upon the resolution of the curve. As the number of cells approaches the maximum, the grid dimension calculation becomes more accurate. If a grid having more than the maximum number of cells is selected, however, then the accuracy of the grid dimension calculation begins to decrease. Typically, the maximum number of cells in a grid is one thousand (1000).

Figure 19:
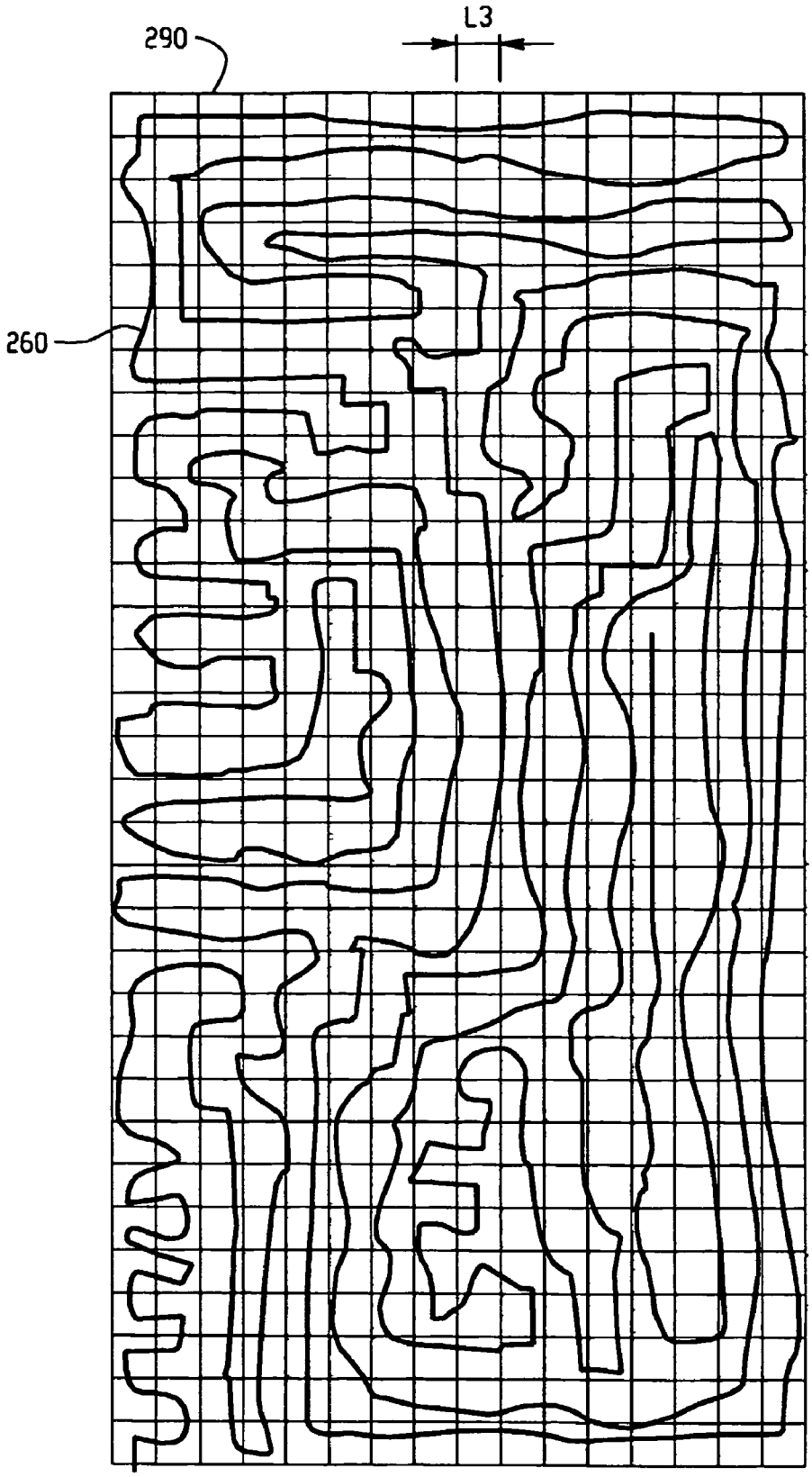

For example, FIG. 19 shows the same antenna 260 enclosed in a third grid 290 with five hundred twelve (512) square cells, each having a length L3. The length (L3) of the cells in the third grid 290 is one half the length (L2) of the cells in the second grid 280, shown in FIG. 18. As noted above, a portion of the antenna 260 is enclosed within every square cell in the second grid 280, thus the value of N for the second grid 280 is one hundred twenty-eight (128). An examination of FIG. 19, however, reveals that the antenna 260 is enclosed within only five hundred nine (509) of the five hundred twelve (512) cells in the third grid 290. Therefore, the value of N for the third grid 290 is five hundred nine (509). Using FIGS. 18 and 19, a more accurate value for the grid dimension ($D_g$) of the antenna 260 may be calculated as follows:

$$D_g = -\frac{\log(509) - \log(128)}{\log(2 \times L2) - \log(L2)} \approx 1.9915$$

The multi-band monopole antennas disclosed herein also include multiple conductor, double-sided, double-surface antenna arrangements. These multiple conductor, double-sided, double-surface antenna arrangements include all the aspects of the multi-band monopole antennas discussed above including, but not limited to, the physical properties of the substrate and conductive materials. In such double-sided, double-surface antenna arrangements, conductors are located on different surfaces of an antenna substrate. Each of the conductors can have the same or different geometry. Conductors on different sides of an antenna substrate can be physically, electrically connected or they may not be connected. Conductors on different sides of an antenna substrate can be connected by a coupling mechanism, e.g., an internal passage or via containing a conductor or an external conductor. Options for conductors include, but are not limited to, conductors with space-filling or grid dimension curves as discussed above, conductors with multiple arms as discussed above, and conducting plates that acts as parasitic reflector planes to tune the resonant frequency of a second band of another conductor.

Figure 20A:
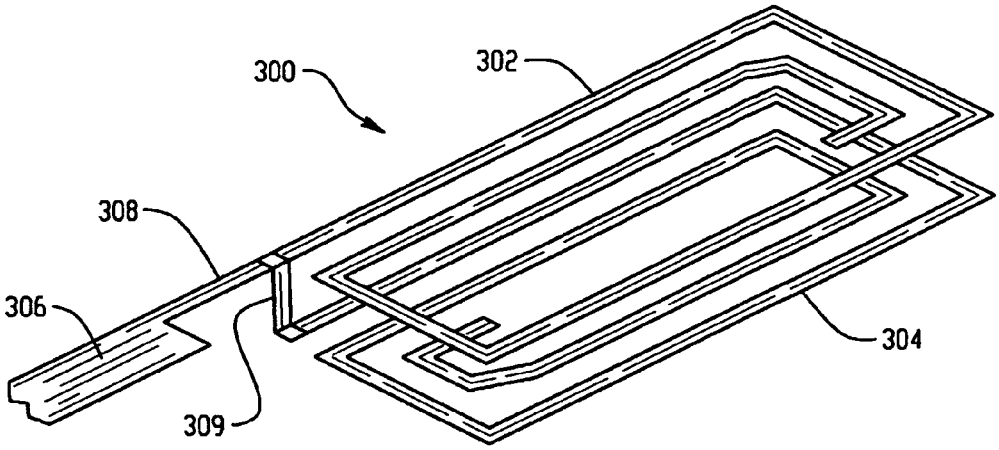
FIG. 20*a* is a perspective view of a double-sided, double-surface antenna with two spiral conductors in the absence of a substrate.
Figure 20B:
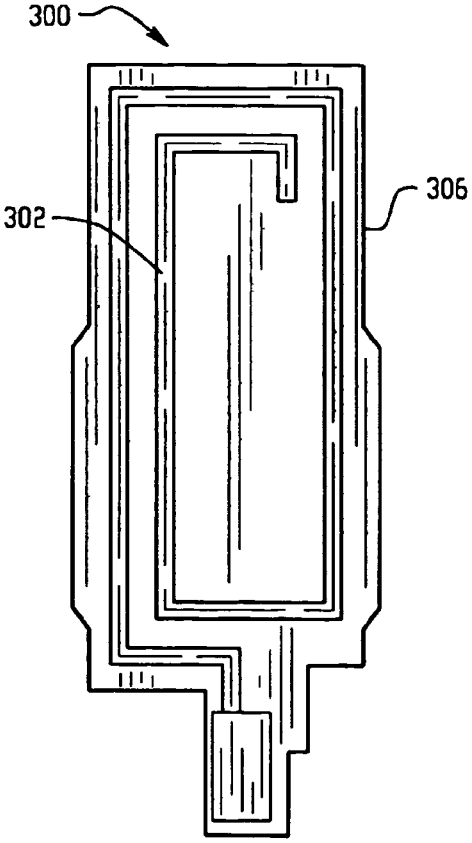
FIG. 20*b* is a front view of a double-sided, double-surface antenna with two spiral conductors with a substrate.
Figure 20C:
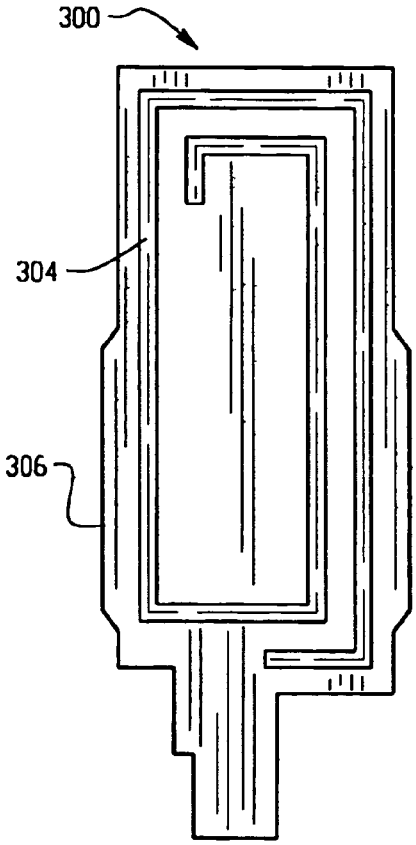
FIG. 20*c* is a back view of a double-sided, double-surface antenna with two spiral conductors with a substrate.

FIGS. 20*a*, 20*b* and 20*c* show an example of a double-sided, double-surface antenna 300 with two spiral conductors (302 and 304). FIG. 20*a* is a perspective view of the conductors of the double-sided, double-surface antenna 200. An antenna substrate, may be included between the spiral conductors 302 and 304. Suitable antenna substrate materials are well known and may include, for example, plastic, FR4, teflon, Arlon®, Rogers®, and fiberglass. FIGS. 20*b* and 20*c* are views of the front and back of the double-sided, double-surface antenna 300 including a substrate 306. Referring to FIGS. 20*a*, 20*b*, and 20*c*, spiral conductor 302 may be located on the front face of antenna substrate 306 and spiral conductor 304 may be located on the back face of antenna substrate 306. Spiral conductor 302 is connected to a feeding port 308 and spiral conductor 302 is connected to spiral conductor 304 by connector 309. Connector 309 electrically connects spiral connectors 302 and 304 and passes through an internal passage of the antenna substrate 306.

Figure 21A:
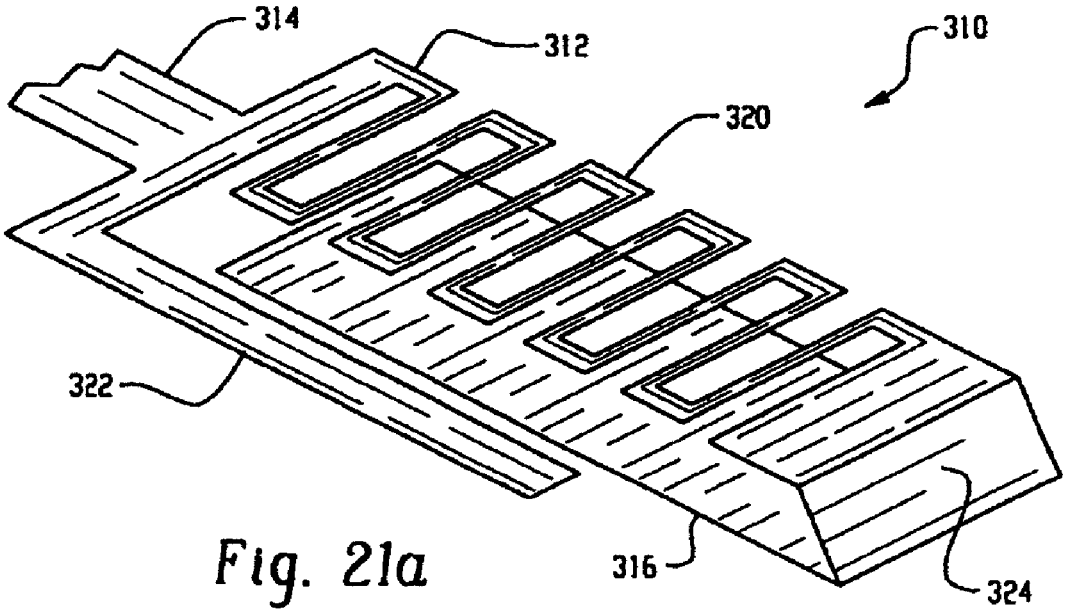
FIG. 21*a* is a perspective view of a double-sided, double-surface antenna with a dual branched conductor and a conducting plate in the absence of a substrate.
Figure 21B:
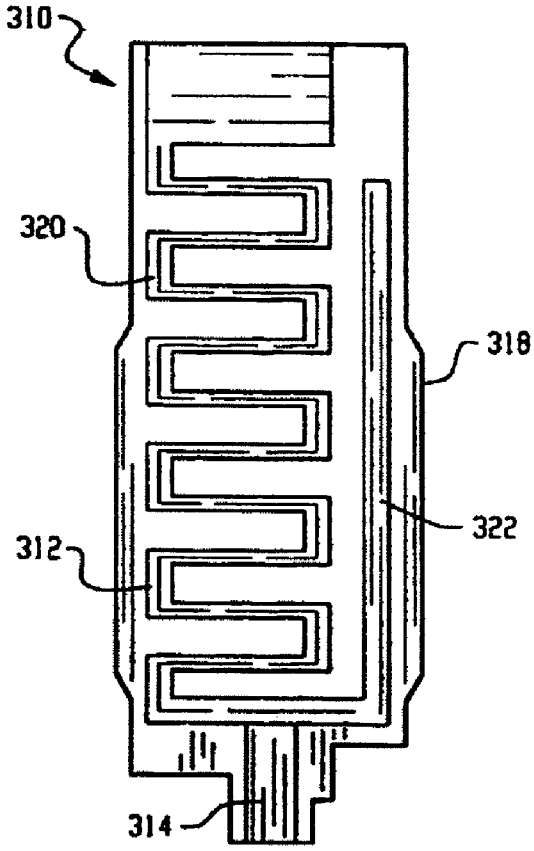
FIG. 21*b* is a front view of a double-sided, double-surface antenna with a dual branched conductor and a conducting plate with a substrate.
Figure 21C:
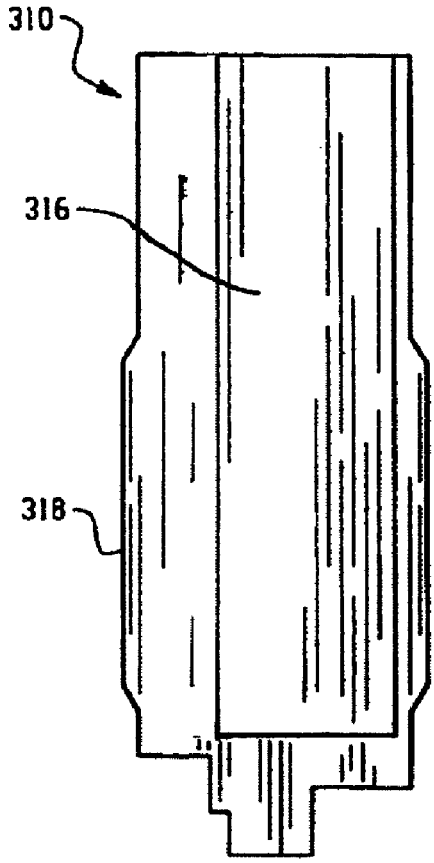
FIG. 21*c* is a back view of a double-sided, double-surface antenna with a dual branched conductor and a conducting plate with a substrate.

FIGS. 21*a*, 21*b* and 21*c* show an example of a double-sided, double-surface antenna 310 with a dual branched antenna 312, a feeding port 314, and a conducting plate 316. FIG. 21*a* is a perspective view of the conductors of the double-sided, double surface antenna 310. Similar to double-sided, double-surface antenna 300, an antenna substrate may be located between the dual branched antenna 312 and the conducting plate 316. FIGS. 21*b* and 21*c* are views of the front and back of the double-sided, double surface antenna 310 including a substrate 318. The dual branched antenna 312 comprises two conductors: a space-filling or grid dimension section 320 and a linear section 322 (further examples of dual and multi-band antennas are discussed above).

Conducting plate 316 can either be an extension of the space-filling or grid dimension section 320 of the dual branched antenna 312 if electrically connected to space-filling or grid dimension section 320 or a parasitic plane reflector if not electrically connected to space-filling or grid dimension section 320. If the plane 324 is used to represent a conductor electrically connecting the end of the space-filling or grid dimension section 320 of the dual branched antenna 312 to the conducting plate 316, then the conducting plate acts as an extension of the space-filling or grid dimension section 320 of the dual branched antenna 312 and will also provide some of the tuning properties of a parasitic plane reflector. If the plane 324 is not a conductor connecting the end of the space-filling or grid dimension section 320 to the conducting plate 316, then the conducting plate acts as a parasitic plane reflector. Conductors connecting the space-filling or grid-dimension section 320 to the conducting plate 316 can be any type of electrical connection and the electrical connection can occur at any points along their common length. The electrical connection also can be located in any orientation such as, for example, over the substrate surface or through an internal passage of the substrate.

Figure 22A:
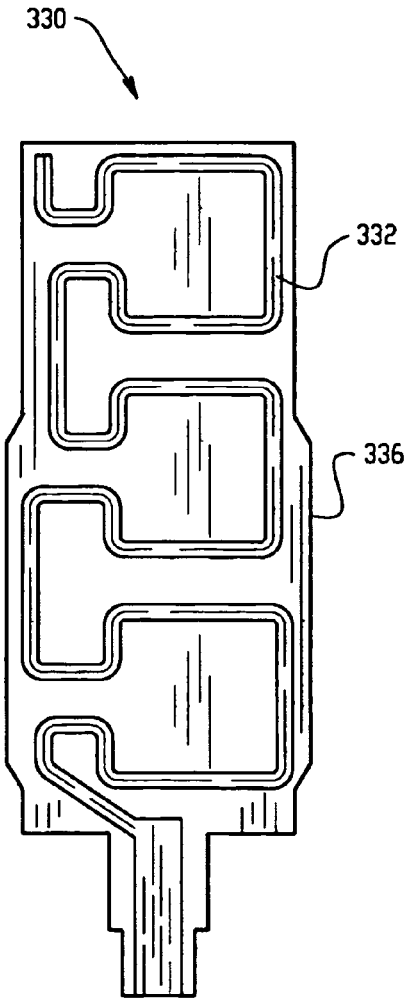
FIG. 22*a* is a front view of a Rogers-type double-sided, double-surface antenna showing a Hilbert-like space-filling conductor.
Figure 22B:
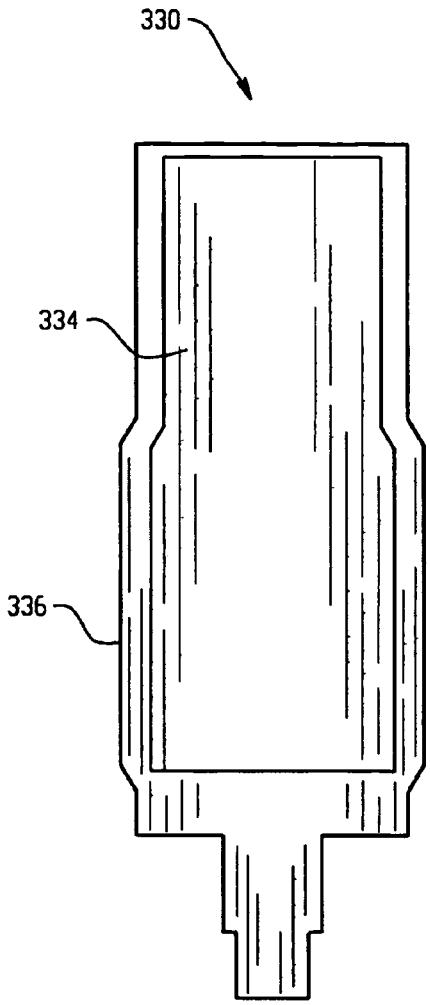
FIG. 22*b* is a back view of a Rogers-type double-sided, double-surface antenna showing a parasitic plate reflector.

Another antenna example is shown in FIGS. 22*a* and 22*b*. The antenna shown in FIGS. 22*a* and 22*b* is an example of a double-sided, double-surface antenna 330 with a conductor 332 and reflector 334 located on an antenna substrate 336. Antenna 330 is a Rogers-type antenna. The conductor 332 of antenna 330 has a Hilbert-like space-filling antenna that is located on the front face of substrate 336. The reflector 334, which is located on the back face of substrate 336, acts as a parasitic plane reflector that helps to tune the resonant frequency of the conductor 332 located on the front face of substrate 336.

Figure 23A:
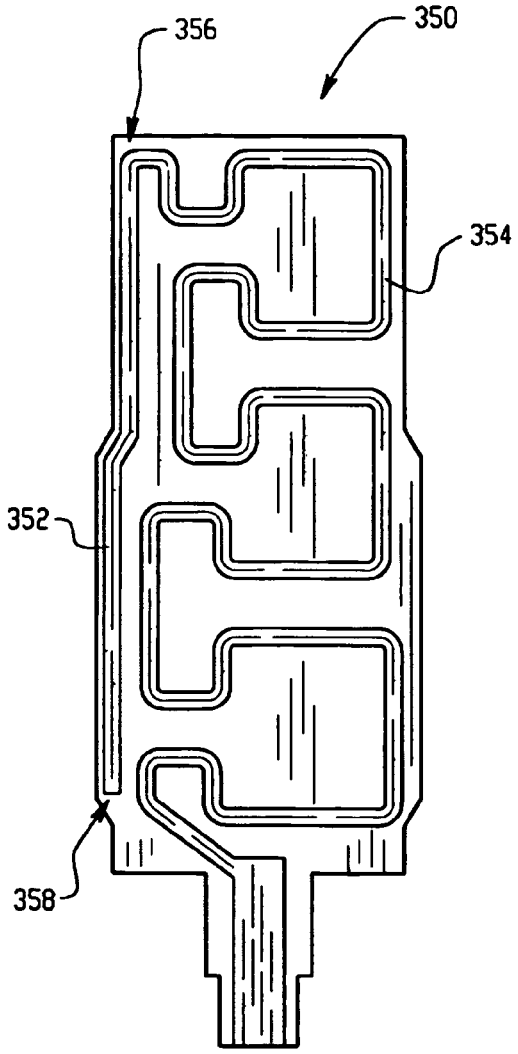
FIG. 23*a* is a front view of a double-sided, double-surface antenna showing a modified Hilbert-like space-filling conductor.
Figure 23B:
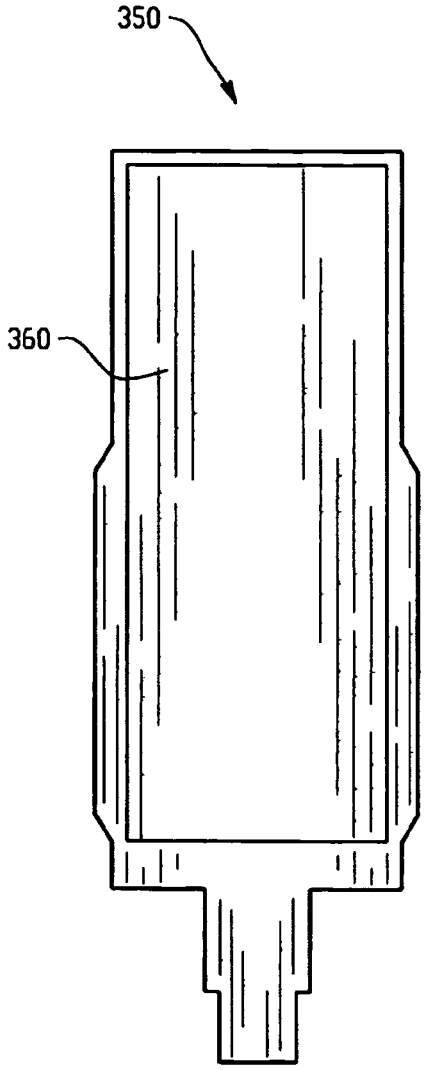
FIG. 23*b* is a back view of a double-sided, double-surface antenna showing a parasitic plate reflector.

FIGS. 23*a* and 23b show another example of a double-sided, double-surface antenna 350. Antenna 350 is a modification of antenna 310 shown in FIGS. 21*a*, 21*b* and 21*c*. The first difference between antenna 350 and antenna 310 is that linear section 320 of antenna 310, i.e., linear section 352 of antenna 350, is now connected to the Hilbert-like space-filling section 354 of antenna 350 at the distal end 356 of the Hilbert-like space-filling section 354 rather than at the proximal end 358. The Hilbert-like space filling section 354 of antenna 350 can, for example, be tuned to the GSM900 frequency band and the modification to linear section 352 could help to reduce the resonant frequency of the GSM900 band. The second difference between antenna 350 and antenna 310 is that a conducting plate 360 has been added to the back face of the antenna substrate to create a parasitic plane reflector. The linear portion 352 of antenna 350 can, for example, be tuned to the GSM1800 band and the parasitic plane reflector could help tune the frequency of the GSM1800 band.

Many modifications to the antennas described above are possible. For example, the linear portions of antennas 310 or 350 could be lengthened or shortened or the electrical connection relationship with a space-filling or grid dimension conductor can be adjusted. For further example, the space-filling or grid dimension portions of antennas 310, 330 or 350 could have various curves removed or replaced by solid conductor portions. The space-filling or grid dimension portions of these antennas can also adopt any of the configurations defined above. By way of an additional example, conductor plates/parasitic plane reflectors of antennas 310, 330 or 350 can be decreased in width or height or both. Further, the shape of a conductor plate/parasitic plane reflector could be modified in other ways, such as by removing various portions of the conductor/reflector or simply creating differing shapes.

Figure 24:
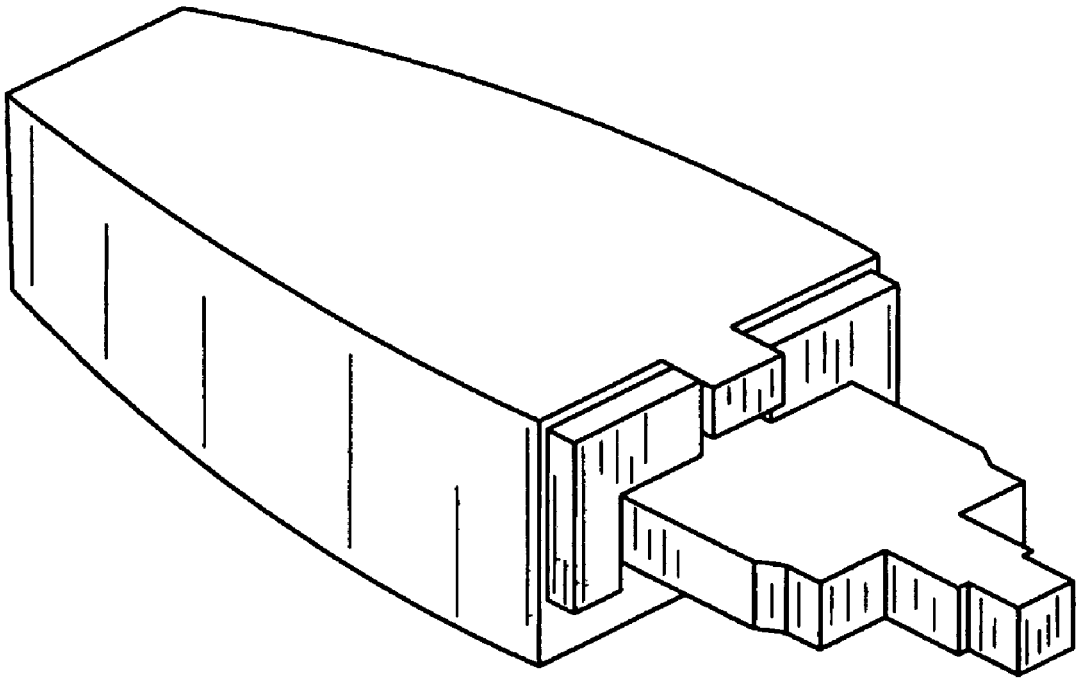
FIG. 24 is an example of an external antenna housing that might be fitted with one of the described antennas.

FIG. 24 shows an example of an antenna housing that any one of the antennas described above could be fitted within. Such an antenna housing could be affixed, for example, to a candy bar type mobile communication device, to a clam-shell type mobile communication device, to a gaming device, or to a PDA.

This written description uses examples to disclose the invention, including the best mode, and also to enable a person skilled in the art to make and use the invention. The patentable scope of the invention is defined by the claims, and may include other examples that occur to those skilled in the art. Such other examples, which may be available either before or after the application filing date, are intended to be within the scope of the claims if they have structural elements that do not differ from the literal language of the claims, or if they include equivalent structural elements with insubstantial differences from the literal language of the claims.

The invention claimed is:

1. An antenna for use in a mobile communication device, comprising:

an antenna substrate with a base, a top, a front side and a back side;

a first conductor located on the front side of the antenna substrate, said first conductor comprising a dual branched antenna with a space-filling or grid dimension branch and a linear branch; and a second conductor located on the back side of the antenna substrate, said second conductor comprising a conducting plate.

2. The antenna of claim 1, wherein the first conductor and the second conductor are electrically connected.

3. The antenna of claim 2, wherein the first conductor and the second conductor are electrically connected through one or more holes cut in the antenna substrate.

4. The antenna of claim 1, wherein the first conductor is connected to a feeding port used to form an electrical connection between the antenna and a mobile communication device.

5. The antenna of claim 1, wherein the space-filling or grid dimension branch of the first conductor receives frequencies in the GSM900 band.

6. The antenna of claim 1, wherein the linear branch of the second conductor receives frequencies in the GSM1800 band.

7. The antenna of claim 1, wherein the second conductor acts as a parasitic plane reflector.

8. The antenna of claim 1, wherein the second conductor is positioned behind the space-filling or grid dimension branch of the dual branched conductor.

9. The antenna of claim 1, wherein the second conductor is smaller than the space-filling or grid dimension branch of the dual branched antenna and the second conductor is positioned behind a portion of the dual branched antenna.

10. The antenna of claim 1, wherein the second conductor has a non-rectangular shape.

11. The antenna of claim 1, wherein one or more curves of the space-filling or grid dimension branch of the dual branched antenna are replaced by a solid conductor portion.

12. The antenna of claim 1, wherein the linear branch of the first conductor is electrically connected to the space-filling or grid dimension branch near a proximal end of the space-filling or grid dimension branch, said proximal end of the space-filling or grid dimension branch located near the base of the antenna substrate.

13. The antenna of claim 1, wherein the linear branch of the first conductor is electrically connected to the space-filling or grid dimension branch at a distal end of the space-filling or grid dimension branch.

14. A housing for use with a mobile communication device containing the antenna of claim 1.

15. A multi-band monopole antenna for external use in a mobile communication device, comprising:

an antenna substrate with a base, a top, a front side and a back side;

a first conductor located on the front side of the antenna substrate, said first conductor comprising a dual branched antenna with a space-filling or grid dimension branch for receiving frequencies in the GSM900 band and a linear branch for receiving frequencies in the GSM1800 band; and a second conductor located on the back side of the antenna substrate, said second conductor comprising a conducting plate that is positioned behind the space-filling or grid dimension branch of the dual branched antenna, wherein the first conductor and the second conductor are electrically connected at the top of the antenna substrate through holes in the antenna substrate.

* * * * *